US006638419B1

(12) United States Patent
Da Silva et al.

(10) Patent No.: US 6,638,419 B1
(45) Date of Patent: Oct. 28, 2003

(54) METHOD FOR OBTAINING OIL PRODUCTS WITH LOW SULPHUR CONTENT BY DESULFURIZATION OF EXTRACTS

(75) Inventors: Pedro Da Silva, Le Havre (FR); Raphaël Le Gall, Le Havre (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

(21) Appl. No.: 09/959,639

(22) PCT Filed: May 3, 2000

(86) PCT No.: PCT/FR00/01188

§ 371 (c)(1),
(2), (4) Date: Jan. 10, 2002

(87) PCT Pub. No.: WO00/68342

PCT Pub. Date: Nov. 16, 2000

(30) Foreign Application Priority Data

May 5, 1999 (FR) ..... 99 05700

(51) Int. Cl.[7] ..... C10G 45/00

(52) U.S. Cl. ..... 208/208 R; 208/240; 208/237; 208/238; 208/219; 208/222; 208/223; 208/196; 435/282; 435/262; 435/281

(58) Field of Search ..... 208/208 R, 240, 208/237, 238, 219, 222, 223, 196; 435/282, 262, 281

(56) References Cited

U.S. PATENT DOCUMENTS 5,232,854 A * 8/1993 Monticello ..... 435/282
6,402,940 B1 * 6/2002 Rappas ..... 208/240

* cited by examiner

*Primary Examiner*—Walter D. Griffin
*Assistant Examiner*—James Arnold, Jr.
(74) *Attorney, Agent, or Firm*—Sughrue Mion, PLLC

(57) ABSTRACT

A method for obtaining oil products such as diesel fuel with improved quality, from a gas oil fraction containing organosulphur compounds such as dibenzenethiophenes and/or their derivatives, with initial and final boiling points generally ranging between about 170 and 480° C. The method includes at least two steps which consist in: (a) liquid-liquid extraction wherein the diesel fuel fraction is contacted with a solvent so as to obtain a gas oil-type raffinate with low content of sulphur and aromatic compounds and an extract rich in solvent and with high content of sulphur and aromatic compounds; (b) oxidation of the extract sulphur compounds so as to obtain, after separation, a heavy gas oil-type hydrocarbon effluent with low sulphur content, and a residue comprising oxidased organosulphur compounds. The invention also concerns oil products obtained by said method which can be used either for the formation of fuel for internal combustion engine with compression ignition (of the diesel type) or as fuel.

11 Claims, 1 Drawing Sheet

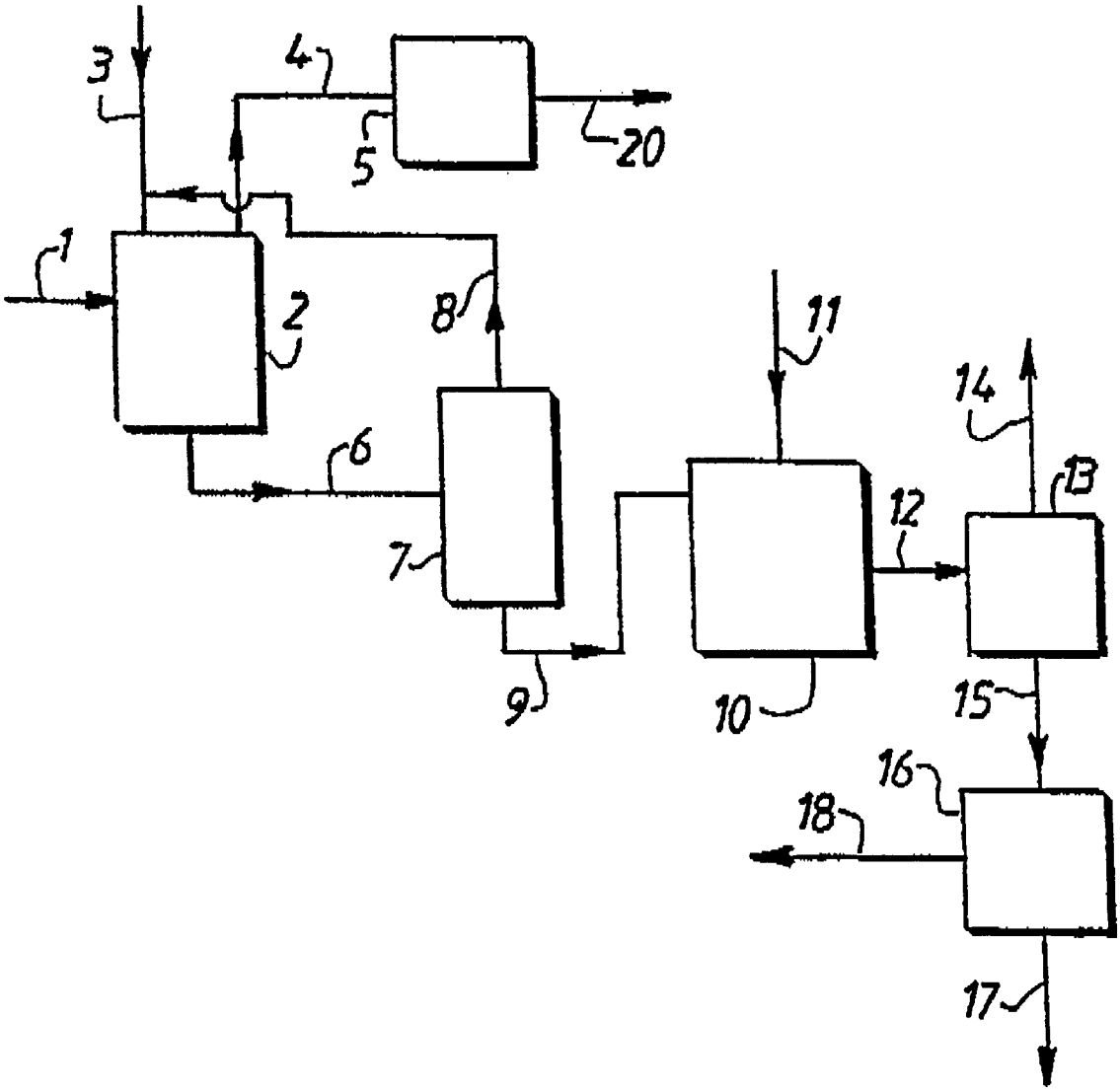
SOLE FIGURE

METHOD FOR OBTAINING OIL PRODUCTS WITH LOW SULPHUR CONTENT BY DESULFURIZATION OF EXTRACTS

The invention relates to a method for obtaining oil products that can possibly be used either for the formulation of fuel for internal combustion engines with compression ignition (of the diesel type) or as a fuel, as well as the oil product of the gas oil type and the sub-products obtained by this method.

The gas oils currently found on the market in France in the form of fuels for diesel type engines, are products of the refining that contain sulfur in a quantity equal at most to 0.05% by weight (500 ppm, or parts per million); however, stricter and stricter standards of sulfur content are being considered, namely by the European Union for the year 2000 (<350 ppm) and for 2005 (≦50 ppm).

These gas oils are usually obtained following a treatment called hydrodesulfurization from very diverse hydrocarbon charges that can result from the direct distillation of a crude oil, from viscosity breaking, from hydroconversion or from catalytic cracking. Among the sulfur compounds contained in these charges, we find in order of increasing difficulty of elimination: thio alcohols, sulfides and disulfides, then thiophenes, and within this group, namely the family of dibenzenethiophenes (DBT) and their alkyl derivatives, which are known for being the compounds most resistant to desulfurization.

The catalytic hydrodesulfurization method consumes large quantities of hydrogen and must be operated at higher and higher temperatures and pressures or at a lower hourly space speed of the charge, and with more performing catalysts when we wish to eliminate said last quantities of sulfur contained in said organosulfur compounds; yet this makes the installations more and more costly and the method less interesting from an economic point of view.

This is why various alternatives have been proposed to try and correct these disadvantages.

This is namely the case of the method for obtaining a gas oil fraction from a hydrocarbon charge with a high sulfur content, described in the patent EP-0 621 334, which combines at least one liquid/liquid extraction step per solvent making it possible to extract at least in part the polyaromatic compounds that are contained in said charge and one or several hydrodesulfurization steps, more or less advanced. The major disadvantages of such a method are on the one hand that it combines one low pressure unit and one or several high pressure units and, on the other hand, that the extract obtained with a high concentration of sulfur or polyaromatic compound it is not easy to upgrade.

Another path that has been explored for some time, consists in using a method of desulfurization of hydrocarbon charges through the culture of specific microorganisms such as bacteria (or biocatalytic desulfurization), that produce enzymes that catalyze the degradation of the resistant compounds such as dibenzenethiophenes; however the difficulty of selecting said microorganisms came from their specific action by cutting the C—C links of the organosulfur compounds, which generated a loss of quality of said charges and in particular of their calorific power; however genetically modified microorganisms, acting by oxidation cutting of the C–S links of the dibenzenethiophenes, were described namely in the patents U.S. Pat. No. 5,002,888, U.S. Pat. No. 5,104,801 and U.S. Pat. No. 5,132,219; the bio-desulfurization reaction passes through the following successive intermediary products: DBTsulfoxides, DBTsulfones; HPBSulfinates (hydroxyphenyl-benzenesulfinate), HPBSulfonates and the 2-hydroxybiphenyl and non organic sulfate final products.

In using specific genetically modified microorganisms as biocatalysts, we can stop the reaction at the stage of the intermediary products such as the hydroxyphenyl-benzenesulfinates or their derivatives, which are soluble in water and can thus be extracted from the hydrocarbon charges. However, the implementation of such a method requires the formation of an oil/water and biocatalyst emulsion, in a reactor whose ratio by volume can be 25/75%, and produces as a disadvantage the use of treatment capacities with high volumes.

U.S. Pat. No. 5,232,854 describes an advanced desulfurization method of a hydrocarbon charge, consisting of a traditional hydrodesulfurization step followed by a biocatalytic desulfurization step by incubation of the charge in the presence of oxygen with microorganisms such as those described in the above-mentioned patents and a step for separating the hydrocarbon effluent with a sulfur content of ≦500 ppm from the residues in the form of non organic sulfurs. However, such a method does not make it possible to reduce the sulfur content of the charges treated at rates that are clearly less than 500 ppm, for example approximately 50 ppm.

This is why the object of this invention is thus to improve the advanced desulfurization of hydrocarbon charges with a high sulfur content, without implementing high temperature and pressure conditions, while upgrading the sub-products obtained.

Surprisingly, the Applicant has established that it is particularly wise to couple the extraction and oxidizing desulfurization steps that take place under low temperature and pressure conditions, close to room temperature and atmospheric pressure, and without consuming hydrogen, therefore very interesting from an economic point of view, and namely to concentrate the more resistant organosulfur compounds using an extraction method, then to treat the extracts obtained using a method of desulfurization by oxidation, so as to separate the hydrocarbon effluents obtained with a low sulfur content from the oxidized organosulfur compounds and recuperate said sub-products; the latter can then be upgraded, after treatment, namely as detergents.

With this end in view, the object of the invention is a method for obtaining oil products of the gas oil type with improved quality, from a gas oil fraction that contains organosulfur compounds of the dibenzenethiophene type and/or their derivatives, with initial and final boiling points usually ranging between 170 and 480° C., characterized by the fact that it comprises at lest two steps, one a) a liquid/liquid extraction step wherein the gas oil fraction is put in contact with a solvent, so as to obtain a gas oil type raffinate with a low content of sulfur and aromatic compounds and an extract rich in solvent and a high content in sulfur an aromatic compounds and the other b) oxidation of the extract sulfur compounds, so as to obtain, after the separation, a heavy gas oil type hydrocarbon effluent with low sulfur content, and a residue comprising oxidized organosulfur compounds.

According to a first preferred mode of execution, the two steps are carried out at pressures that are less than or equal to 1 MPa, and at temperatures ranging between room temperature and 100° C.

In particular, the solvent used in step a) is chosen from among the group consisting of methanol, acetonitrile, monomethyl formamide, dimethyl formamide, dimethyl acetamide, N-methyl-pyrrolidone, dimethyl sulfoxide and furfural.

According to a second preferred mode of execution, step b) consists of a biodesulfurization in which the extract is treated in a reactor, possibly cleared of the solvent, preferably at atmospheric pressure, in the presence of a biocatalyst in an aqueous phase, comprising an appropriate strain of microorganisms that produce enzymes capable of oxidizing the organosulfur compounds.

In particular, step b), when it is a biodesulfurization, is followed by a first step c) of separation of the oily phase that contains the hydrocarbon effluent and of the aqueous phase, where the latter contains the biocatalyst and the residue comprised of compounds of the organosulfinate type, in particular, benzenesulfinates and/or their derivatives; where the latter are formed by the opening of the thiophenic cycles by oxidation.

Preferably, the separation of the residue and the biocatalyst is done in during a second step d) of separation, that consists either of an extraction by a polar solvent or over ion exchanging resins, or of a filtration or of an adsorption over a polar solid support.

According to another variant of execution, step b) consists of a chemical oxidation; the latter can be executed namely with oxidizing agents of the peroxide type.

In this case, the residue of step b), obtained after separation, consists of compounds of the sulfoxide or sulfone type.

More specifically, the biodesulfurization step is carried out at pressures that are less than 1 MPa, and namely at atmospheric pressure, in the presence of air, and at temperatures that range between room temperature and 40° C.

Advantageously, the beginning gas oil fraction is a direct distillation fraction, or comes from a hydrocracking, catalytic cracking, viscosity breaking or coking operation; its sulfur content is generally greater than or equal to 1% by weight.

Preferably, the hydrocarbon effluent of step b) has a final boiling point that is less than or equal to 380° C.

Advantageously, the method as set forth in the invention comprises an additional distillation or decantation step of the extract from step a) making it possible to obtain an front product rich in solvent, which is recuperated and recycled during the extraction step and an end product depleted in solvent that is introduced in step b); one can also consider a distillation step of the raffinate from step a), in order to recuperate the low quantity of solvent it still contains.

According to a variant of execution, the method also consists of an additional hydrotreatment step of the hydrocarbon effluent obtained in step c), namely hydrodesulfurization under soft conditions.

In implementing the method of the invention, we can obtain an oil product of the gas oil type, with a sulfur content that is less than 500 ppm and preferably less than 50 ppm.

Compounds of the benzenesulfinate type obtained by the method as set forth in the invention, after having undergone an additional treatment such as oxidation followed by alkylation or alcylation, can be used as hydrotropic agents or surfactants, namely in the manufacturing of detergents.

The chemical oxidation of step b) can be carried out in a homogenous phase at low temperature (approximately 70–80° C.) and at atmospheric pressure, in the presence of a peroxidizing agent (for example hydrogen peroxide) and an acid catalyst such as acetic acid or sulfuric acid. The separation of the sulfones obtained and the hydrocarbon effluent can be done on an adsorbent mass, such as for example silica gel. Any other type of oxidation can be used, namely an oxidation by Oxon (potassium peroxymonosulfate) is also possible.

A first advantage presented by the method as set forth in the invention is to allow the use of hydrocarbon fractions, for example of the gas oil type, with an initial boiling point of approximately 170° C. and a final boiling point of approximately 375° C. (the temperatures of the boiling points as indicated are measured as according to the TBP "true boiling point"0 distillation method), having already undergone a traditional catalytic hydrodesulfurization and with a residual sulfur content that is less than 500 ppm, and to concentrate, using the liquid-liquid type extraction step with a solvent that has an increased selectivity for dibenzenethiophenes and their derivatives, said compounds in the extract phase that is sent to the following step. The raffinate obtained in this extraction consists of a hydrocarbon charge with a low content of sulfur and aromatic compounds, that is sent to the engine gas oil pool (the pool is the name that designates all base products used to manufacture an oil product).

A second advantage is to carry out the two steps at a pressure that is less than 1 MPa and a temperature that is less than 100° C., and preferably at atmospheric pressure and room temperature.

We can also consider previously subjecting the beginning hydrocarbon fraction, with a sulfur content that is less than 1% by weight, to a fractionation under conditions that make it possible to obtain a front product that is a fraction whose final boiling point is less than 320° C. (considering the boiling point of the dibenzenethiophene is close to 330° C.) with a sulfur content that is less than 1% by weight, and an end product whose initial boiling point is greater than 320° C. (for example a TBP fraction of 320–380° C.), comprising a high concentration of refractory sulfur compounds and that will be sent to the following extraction step.

As beginning gas oil fraction we can also use LCO type fractions (very aromatic "Light cycle oil"0 fraction produced by effluents of a catalytic cracking unit), with much higher sulfur contents that can reach 2.5% by weight, or even more.

The liquid-liquid extraction step is carried out in the traditional way, against the current, in an extraction column whose packing is, for example, fixed disks and rings, rotary disks or static mixers, preferably with 5 to 10 theoretical stages, at a temperature that ranges between 30° C. and 100° C., and under a pressure that ranges between 0.1 and 1 MPa; generally, the solvent to charge volume ratio is between 0.2/l and 5/l.

The solvent is preferably chosen from the group of solvents that make it possible to extract at least a part of the mono and polyaromatic and sulfur compounds, where this group is comprised of methanol, acetonitrile, monomethyl formamide, dimethyl formamide, dimethyl acetamide, N-methyl-pyrrolidone, dimethyl sulfoxide and furfural. We can also add a cosolvent that can be a linear or branched alcohol to the solvent.

We thus obtain a raffinate that is a gas oil fraction with a low sulfur content and that can be sent to the engine gas oil pool, after having been purified by eliminating the traces of solvent it contains, by distillation; furthermore, the extract obtained, with a high solvent content and high in sulfur and aromatic compounds, will be sent to step b), after having possibly been previously sent to an area of distillation or to any other separation device, in order to recuperate a fraction that contains almost all the solvent.

The oxidation step b) of the sulfur compounds, is carried out so as to obtain, after separation, a heavy gas oil type hydrocarbon effluent with a low sulfur content, that can be sent to the domestic fuel pool, and a residue that contains oxidized organosulfur compounds.

When step b) is a biodesulfurization, it was noticed that the efficiency of the desulfurization depended on the nature of the charge and that it decreased based on whether the gas oil was obtained by cocking, viscosity breaking, catalytic cracking (LCO) and by direct distillation (GOSR, "Gas Oil Straight Run).

First example of execution, as illustrated in the only FIG. attached hereto:

the hydrocarbon fraction used comes from a direct distillation Light Arab gas oil, after fractionation, and has an initial distillation point of 320° C. and a final distillation point of 380° C., a density of 0.87 at 15° C., a polyaromatic content of 14% by weight and a sulfur content of 1.8% by weight; it is introduced through the conduit 1 into the liquid-liquid extraction column 2, that operates at atmospheric pressure and a temperature of 80° C., in which an identical quantity by volume of furfural is introduced against the flow through the conduit 3.

We obtain a raffinate of the gas oil type, with a sulfur content of 0.8% by weight, which after having been cleared of the solvent by distillation, is sent through the conduit 4 to a hydrodesulfurization reactor 5, that operates under the usual conditions such as a partial hydrogen pressure of 2.5 MPa, a temperature of 340° C., an hourly space speed (VVH) of 1.1 $h^{-1}$, a hydrogen debit rate in relation of the charge of 125 N1/1 (where N1 is "Normal" liters), in the presence of a cobalt-molybdenum catalyst supported over alumina, so as to obtain an effluent with a sulfur content of 29 ppm and a density of 0.825, sent through the conduit 20 to the engine gas oil pool and that meets the specifications provided for the year 2005; we recuperate through a conduit 6 an extract with a sulfur content of 5% by weight, which, after having been cleared in a distillation column 7, of the solvent that is recycled through line 8 toward the extraction column 2, is sent through line 9 to the biodesulfurization reactor 10, that operates in the presence of bacteria from the genetically modified IGTS 8 Rhodococuss strain, introduced in an aqueous phase through line 11 and that form an oil-water emulation, at a temperature of 40° C. and at atmospheric pressure, in the presence of air and nutritive substances; the products of the reaction emitted through line 12, are introduced into a separator 13 from where we recuperate through line 14 a heavy gas oil type hydrocarbon effluent, containing 1% by weight of sulfur, which, to be sent to the domestic fuel pool (sulfur content ≦0.2%) must be subjected to a hydrodesulfurization under conditions similar to those that prevail in the reactor 5 (for example at a temperature that ranges between 330 and 340° C.) to as to obtain a sulfur content of 0.17% by weight. The aqueous phase is finally recuperated through line 15, and after a separation step 16 over cationic resins, gives a residue 17 comprised of benzenesulfinates or their derivatives, that can be upgraded after a later treatment, as surfactants, and the biomass 18 that contains the bacteria, of which after separation and regeneration a part can be reintroduced into the reactor 10.

In a second example of execution, using the main steps of the method as set forth in the invention, the hydrocarbon fraction used emanates from a direct distillation Light Arab gas oil, has an initial distillation point of 180° C. and a final distillation point of 380° C., and has undergone a hydrodesulfurization treatment so as to have a sulfur content of 200 ppm; this fraction undergoes a fractionation that makes it possible to obtain an front product that is a fraction whose final boiling point is less than 328° C. and that has a sulfur content of 40 ppm, and therefore meets the specification provided for the year 2005 for engine gas oil, and an end product whose initial boiling point is greater than 328° C. (fraction 328–380° C.), containing a high concentration of refractory sulfur compounds and with a sulfur content of 720 ppm, which is sent to the following extraction step.

After introduction in the extraction column 2, operating under the same conditions as those in example 1, we obtain a gas oil type raffinate, with a sulfur content of 50 ppm, which, after elimination of the solvent, is sent directly to the engine gas oil pool; the extract that exits conduit 6 has a sulfur content of 2300 ppm and is sent to the biodesulfurization reactor 10, which also operates under the same conditions as those in example 1, from which is recuperated through line 14 a heavy gas oil type hydrocarbon effluent, whose sulfur content is 700 ppm, which makes it possible to send it directly to the domestic fuel pool.

What is claimed is:

1. Method for obtaining oil products of the gas oil type with improved quality, from a gas oil fraction containing organosulfur compounds of the dibenzenethiophene type and/or their derivatives, with initial and final boiling points generally ranging between approximately 170 and 480° C., characterized by the fact that it consists of at least two steps, one, a), liquid-liquid extraction in which the gas oil fraction is put in contact with a solvent, so as to obtain a raffinate of the gas oil type with a low content of sulfur and aromatic compounds and an extract rich in solvent and with a high content of sulfur and aromatic compounds, and the other b) oxidation of extract sulfur compounds, so as to obtain, after separation, a heavy gas oil type hydrocarbon effluent with a low sulfur content, and a residue that comprises oxidized organosulfur compounds.

2. Method as set forth in claim 1, characterized by the fact that the two steps are carried out at pressures that are less than or equal to 1 MPa and at temperatures that range between room temperature and 100° C.

3. Method as set forth in claim 1, characterized by the fact that the solvent used in step a) is chosen form the group consisting of methanol, acetonitrile, monomethyl formamide, dimethyl formamide, dimethyl acetamide, N-methyl pyrrolidone, dimethyl sulfoxide and furfural.

4. Method as set forth in claim 1, characterized by the fact that step b) consists of a biodesulfurization in which the extract, possibly cleared of the solvent, is treated in a reactor preferably at atmospheric pressure in the presence of a biocatalyst in aqueous phase, that contains an appropriate strain of microorganisms that generate enzymes capable of oxidizing the organosulfur compounds.

5. Method as set forth in claim 4, characterized by the fact that step b) is followed by a first separation step c) of the oil phase that contains the hydrocarbon effluent and the aqueous phase, where the latter contains the biocatalyst and the residue consisting of compounds of the organosulfinate type, in particular benzenesulfinates and/or their derivatives.

6. Method as set forth in claim 5, characterized by the fact that the separation of the residue and the biocatalyst is carried out in a second separation step d) that consists either of an extraction by a polar solvent or over ion exchanger resins, or in a filtration, or of an adsorption over polar solid support.

7. Method as set forth in claim 1, characterized by the fact that step b) consists in a chemical oxidation.

8. Method as set forth in claim 7, characterized by the fact that the oxidation is carried out in the presence of oxidizing agents of the peroxide type.

9. Method as set forth in claim 1, characterized by the fact that the starting gas oil fraction is a product of direct distillation, or comes from a hydrocracking, catalytic cracking, viscosity reduction or coking operation.

10. Method as set forth in claim 1, characterized by the fact that the starting gas oil fraction has a sulfur content that is greater than or equal to 1% by weight.

11. Method as set forth in claim 1, characterized by the fact that it comprises an additional distillation or decantation step of the extract from step a) making it possible to obtain a front product rich in solvent, that is recuperated and recycled in the extraction step, and an end product depleted of solvent, that is introduced in step b).

* * * * *